US007296368B1

(12) United States Patent
Rigo

(10) Patent No.: US 7,296,368 B1
(45) Date of Patent: Nov. 20, 2007

(54) ROOF SNOW REMOVAL APPARATUS

(76) Inventor: Louis Rigo, 113 Laurie La., Oswego, IL (US) 60543

( * ) Notice: Subject to any disclaimer, the term of this patent is extended or adjusted under 35 U.S.C. 154(b) by 355 days.

(21) Appl. No.: 11/133,853

(22) Filed: May 23, 2005

(51) Int. Cl.
*E01H 5/02* (2006.01)

(52) U.S. Cl. ..... 37/285; 37/265; 37/268; 294/54.5

(58) Field of Classification Search ..... 37/241, 37/266, 265, 268, 270, 284, 285, 434; 294/54.5–59, 294/53.5
See application file for complete search history.

(56) References Cited

U.S. PATENT DOCUMENTS

| | | | | | |
|---|---|---|---|---|---|
| 1,927,196 | A | * | 9/1933 | Young | 37/266 |
| 3,091,790 | A | * | 6/1963 | Schroeder | 15/105 |
| 3,218,738 | A | | 11/1965 | Bowerman | |
| 3,483,643 | A | * | 12/1969 | Erickson | 37/268 |
| 3,583,747 | A | * | 6/1971 | Lambert | 37/268 |
| 3,773,375 | A | | 11/1973 | Nehls | |
| 3,998,486 | A | * | 12/1976 | Mittelstadt | 37/285 |
| 4,024,654 | A | * | 5/1977 | Snyder | 37/268 |
| 4,094,543 | A | * | 6/1978 | Fratini | 294/54.5 |
| 4,185,403 | A | * | 1/1980 | Hardgrove | 37/265 |
| 4,249,767 | A | * | 2/1981 | Andreasen | 294/19.1 |
| 5,083,388 | A | * | 1/1992 | Cooley | 37/268 |
| 5,228,734 | A | * | 7/1993 | Pollastro | 294/54.5 |
| 5,232,260 | A | | 8/1993 | Lippard | |
| D355,286 | S | | 2/1995 | Wallace et al. | |
| 5,465,510 | A | * | 11/1995 | Goodnough et al. | 37/285 |
| 5,524,369 | A | | 6/1996 | Phillips | |
| 5,676,413 | A | * | 10/1997 | Hauck | 294/54.5 |
| 5,749,613 | A | * | 5/1998 | Rapp | 294/58 |
| 5,943,796 | A | | 8/1999 | Hedstrom | |
| 6,018,894 | A | | 2/2000 | Whitehead et al. | |
| 6,092,315 | A | * | 7/2000 | Katauskas | 37/285 |
| 6,158,791 | A | * | 12/2000 | Drew | 294/54.5 |
| 6,189,942 | B1 | * | 2/2001 | Peterson et al. | 294/54.5 |
| 6,338,210 | B1 | | 1/2002 | Mele | |
| 6,578,890 | B1 | | 6/2003 | Gilmore et al. | |

* cited by examiner

*Primary Examiner*—Thomas A Beach

(57) ABSTRACT

An apparatus includes an elongated pole that has a longitudinal axis and further has axial proximal and distal ends. A central anchor includes brackets equidistantly and radially spaced about a perimeter thereof. The anchor threadably receives the proximal end. Coextensive paddles are pivotally connected to the brackets that articulate along a unique pivot axis between extended and retracted positions, and are radially extended from and equidistantly juxtaposed along an outer perimeter of the anchor when a user exerts a linear force towards the proximal end of the pole, fanning the paddles to an extended position. A flexible canvas is connected to the paddles for collecting snow therein when the paddles are fanned to an open position. The canvas is foldable to a compact position when the paddles are at a closed position, and further has an outer edge provided with a radius equal to a longitudinal length of the paddles.

18 Claims, 4 Drawing Sheets

ROOF SNOW REMOVAL APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to snow removal apparatuses and, more particularly, to a roof snow removal apparatus for assisting a user to remove accumulated snow from a roof.

2. Prior Art

Snow has accumulated on roofs for generations. The build-up of snow on roofs can cause serious problems if melting occurs, creating ice dams causing water to back up under shingles and leak through the roof into the house or other building. Also, if the weight of the snow becomes too heavy for the roof to support, caving in of the roof from the weight of snow and water accumulated on the roof can result in dumping snow and water into the house or like building. Thus, not only must the roof itself be repaired, but anything in the interior of the house or like building that acquired water damage must be replaced or repaired. Additionally, this is often a problem which can occur annually. The common practice is to remove the snow, with a shovel, while standing on the roof, a dangerous and a very treacherous task.

One solution to snow build-up is to remove snow off the roofs of houses and like buildings. A common method of snow removal is shoveling which creates a risk of slipping and falling and places undue strain on the back of the person shoveling. Additionally, shovels can only remove a certain amount of snow at a time causing the person shoveling to be subjected to the cold for a longer time than is necessary. Also, shoveling can damage the roof from the shovel being forcefully pushed into the shingles in attempts to remove the bottom layer of snow from the roof.

Other methods such as raking the snow off roofs can cause the snow to fall on top of the person trying to remove the snow and limits the ability to reach the highest or middle part of the roof if the handle is too short. Unless the person using prior rakes climbed onto the roof, which makes accidents more likely, the amount of snow that would get removed would be minimal. Additionally, rakes could pull shingles from the roof or otherwise damage them when the rake is dragged across them.

Accordingly, a need remains for a roof snow removal apparatus in order to overcome the above-noted shortcomings. The present invention satisfies such a need by providing a snow removal apparatus that is easy and convenient to use, lightweight and compact in design, and improves the user's safety. Home owners and owners of small businesses find this apparatus quite helpful, in that it permits an individual to remove roof snow without having to climb onto the roof. In this manner, the snow no longer poses a danger to an individual walking under the snow or the one removing the snow from the roof of a residence or building.

BRIEF SUMMARY OF THE INVENTION

In view of the foregoing background, it is therefore an object of the present invention to provide a roof snow removal apparatus. These and other objects, features, and advantages of the invention are provided by a snow removal apparatus for assisting a user to remove accumulated snow from a roof.

The apparatus includes an elongated rectilinear pole that has a centrally disposed longitudinal axis and further has axially registered proximal and distal end portions. The distal end portion of the pole preferably includes a grip member directly conjoined thereto for advantageously increasing a user's grip.

A central anchor includes a plurality of brackets equidistantly and radially spaced about a perimeter thereof. Such an anchor threadably and directly receives the proximal end portion of the pole. The brackets are preferably securely and statically fastened to the anchor such that the paddles move along a fixed and predetermined arcuate path during operating conditions. The central anchor preferably has a protrusion extending parallel to the longitudinal axis such that a user can advantageously easily insert the apparatus into a bank of snow when the paddles are at a retracted position.

A plurality of coextensive paddles are pivotally connected to the brackets respectively. Each paddle is articulated along a unique pivot axis between extended and retracted positions. The paddles are radially extended from and equidistantly juxtaposed along an outer perimeter of the anchor when a user exerts a linear force directed towards the proximal end portion of the pole for effectively fanning the paddles to an extended position.

A flexible canvas is directly connected to the paddles for effectively and conveniently collecting snow therein when the paddles are fanned to an open position. Such a canvas is foldable to a compact position when the paddles are articulated to a closed position. The canvas further has an outer edge provided with a radius substantially equal to a longitudinal length of the paddles. Such a canvas may be formed from mesh material for allowing a selected quantity of snow and debris to pass therethrough when the user pulls the apparatus away from an edge of a roof top. In an alternate embodiment, the canvas is preferably formed from fluid impermeable material for advantageously prohibiting snow and debris from passing therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
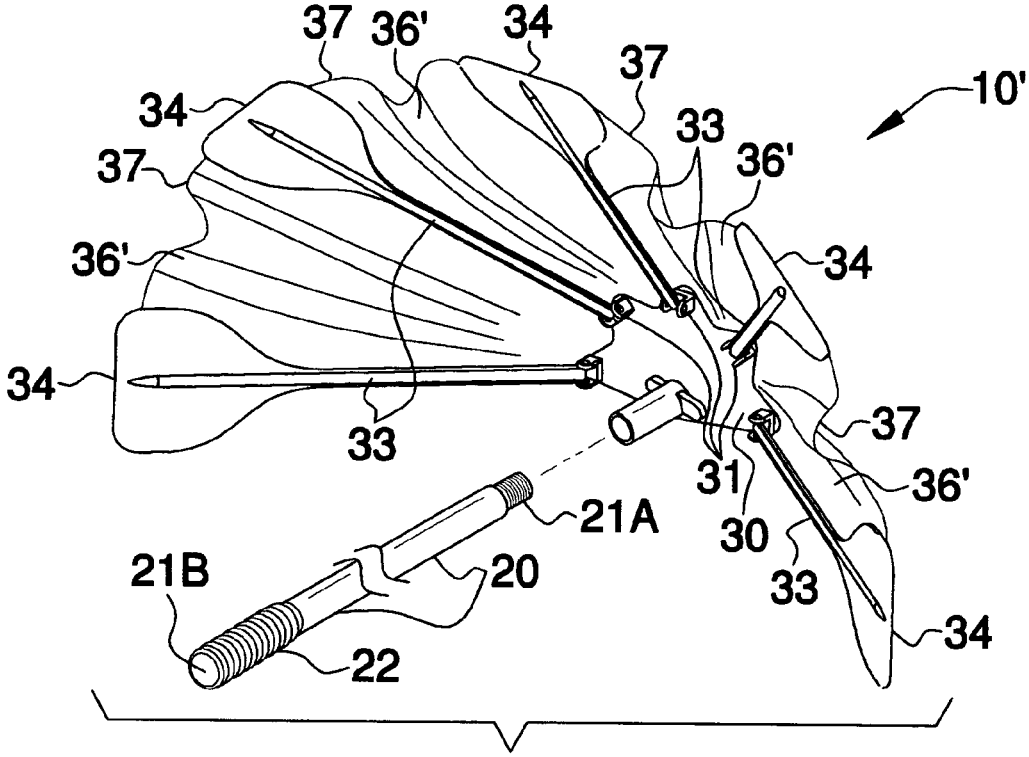
FIG. 1 is a proximal perspective view showing a roof snow removal apparatus, in accordance with the present invention.
Figure 2:
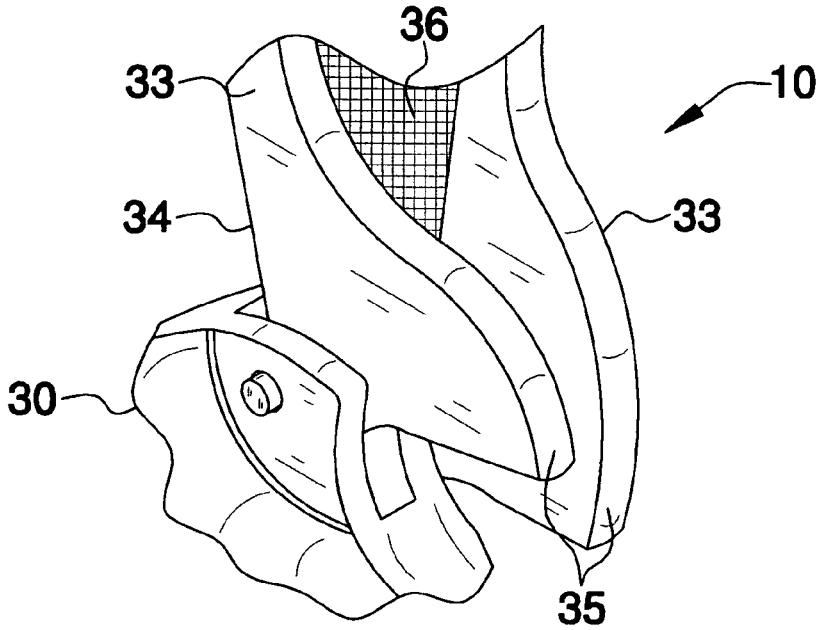
FIG. 2 is an enlarged distal perspective view of the bracket shown in FIG. 1.
Figure 3:
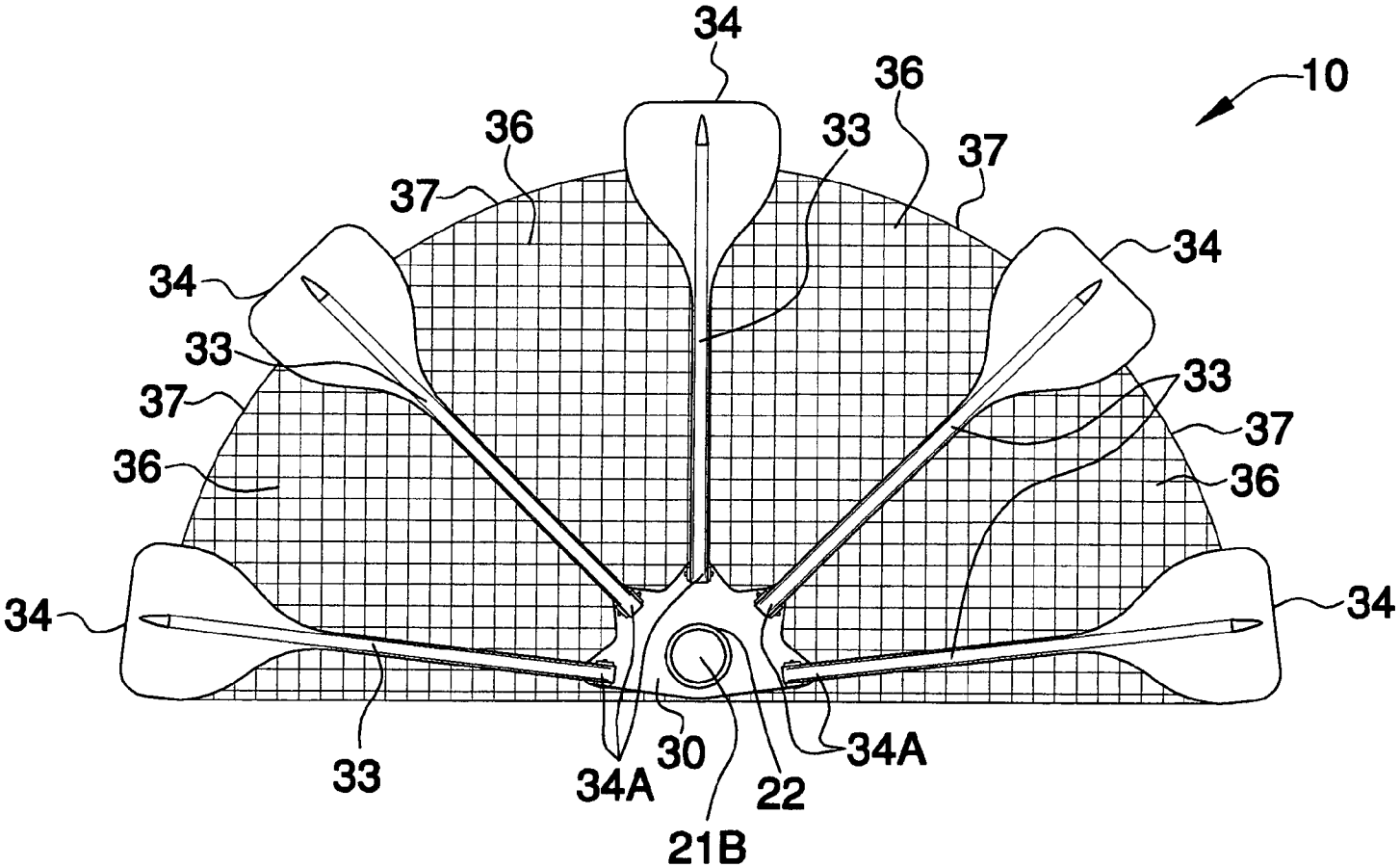
FIG. 3 is a rear-elevational view of the apparatus shown in FIG. 1, showing the paddles and the canvas therebetween at a fully extended position.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refers to alternate embodiments of such elements.

The apparatus of this invention is referred to generally in FIGS. 1-6 by the reference numeral 10 and is intended to provide a roof snow removal apparatus. It should be understood that the apparatus 10 may be used to remove snow from many different types of surfaces and should not be limited in use to only removing snow from roofs.

Referring initially to FIG. 1, the apparatus 10 includes an elongated rectilinear pole 20 that has a centrally disposed longitudinal axis and further has axially registered proximal 21A and distal 21B end portions. Of course, the pole 20 may be produced in a variety of different lengths and shapes, depending on the use thereof, and may even be telescopic, as is obvious to a person of ordinary skill in the art. The distal end portion 21B of the pole 20 includes a grip member 22 directly conjoined, with no intervening elements, thereto for advantageously increasing a user's grip. Such a grip member 22 advantageously prevents the user's hand from slipping off of the pole 20, which may become wet or icy during operating conditions.

Referring to FIGS. 1, 2, 3 and 6, a central anchor 30 includes a plurality of brackets 31 equidistantly and radially spaced about a perimeter thereof. Such an anchor 30 threadably and directly receives, with no intervening elements, the proximal end portion 21A of the pole 20. The brackets 31 are securely and statically fastened to the anchor 30 such that the paddles 33 (described herein below) move along a fixed and predetermined arcuate path during operating conditions. Thus, a user advantageously does not need to guess which direction the paddles will extend upon retracting the pole 20 during operating conditions, allowing for the optimum amount of snow 11 to be removed each time. The central anchor 30 has a protrusion 32 extending parallel to the longitudinal axis, which is essential such that a user can advantageously easily insert the apparatus 10 into a bank of snow 11 when the paddles 33 are at a retracted position.

Figure 4:
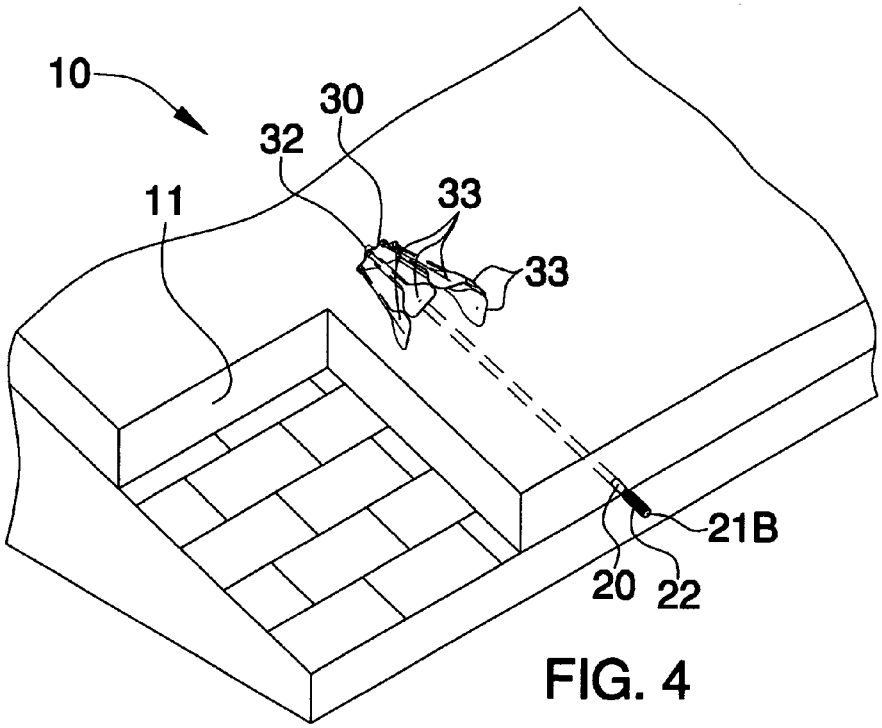
FIG. 4 is an elevated perspective view showing the apparatus inserted into roof snow prior to retraction.
Figure 5:
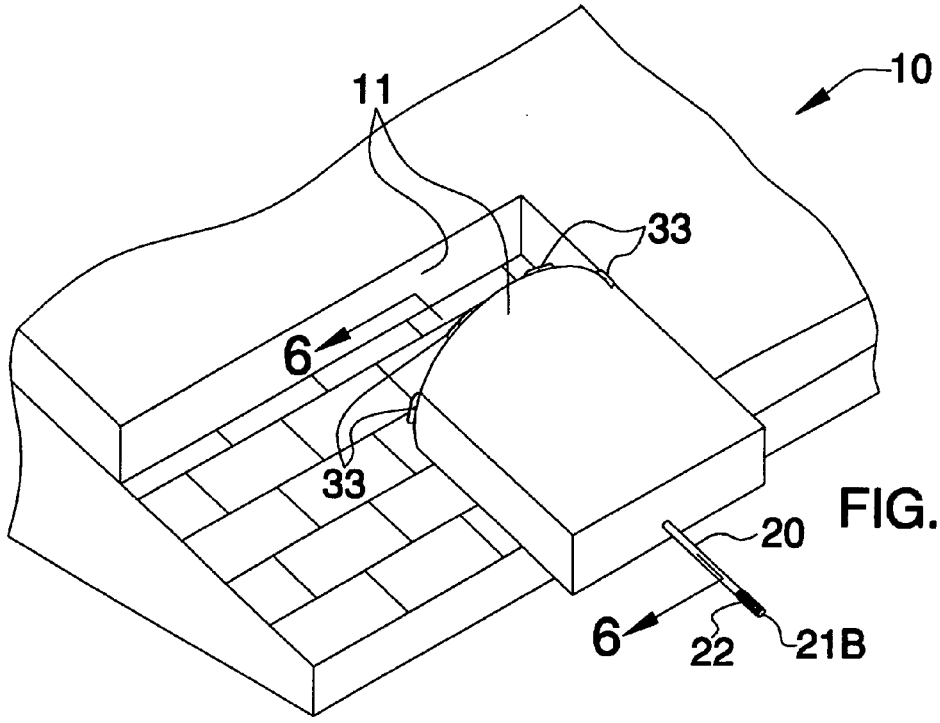
FIG. 5 is an elevated perspective view of the apparatus shown in FIG. 4, showing the extended paddles during retraction.
Figure 6:
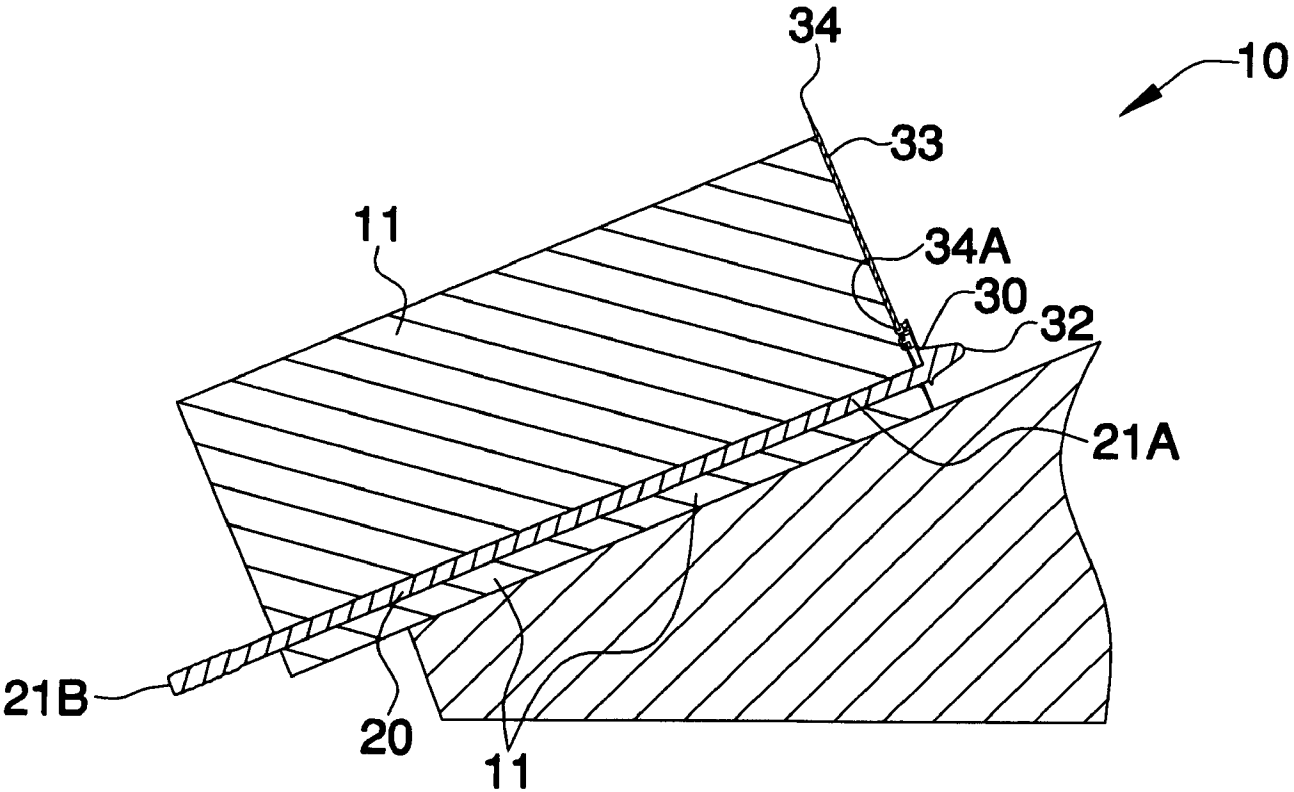
FIG. 6 is a cross-sectional view of the apparatus shown in FIG. 5, taken along line 6-6.

Referring to FIGS. 1, 3, 4, 5 and 6, a plurality of coextensive paddles 33 including opposed end portions 34 are pivotally connected to the brackets 31 respectively. Of course, such paddles 33 may be produced in a variety of different lengths and shapes, as is obvious to a person of ordinary skill in the art. Each paddle 33 is articulated along a unique pivot axis between extended and retracted positions. The paddles 33 are radially extended from and equidistantly juxtaposed along an outer perimeter of the anchor 30 when a user exerts a linear force directed towards the proximal end portion 21A of the pole 20, which is critical for effectively fanning the paddles 33 to an extended position, as is illustrated in FIGS. 5 and 6. Of course, the apparatus 10 may be used to collect other materials, such as leaves, in a similar manner, as is obvious to a person of ordinary skill in the art.

The paddles 33 further include a flange portion 35 monolithically formed at one end portion 34A thereof. Such a flange portion 35 is advantageous and essential for prohibiting the paddles 33 from pivoting beyond a predetermined position in relation to the central anchor 30, thus preventing collected snow 11 and other debris from escaping the canvas 36 (described herein below)

Referring to FIGS. 4, 5 and 6, a flexible canvas 36 is directly connected, with no intervening elements, to the paddles 33, which is essential for effectively and conveniently collecting snow therein when the paddles 33 are fanned to an open position. Such a canvas 36 is foldable to a compact position when the paddles 33 are articulated to a closed position, as best shown in FIG. 4. The canvas 36 further has an outer edge 37 provided with a radius substantially equal to a longitudinal length of the paddles 33. Such a canvas 36 is formed from mesh material for allowing a selected quantity of snow 11 and debris to pass therethrough when the user pulls the apparatus 10 away from an edge of a roof top. This feature is advantageous in preventing the apparatus 10 from collecting more snow than the paddles or a user can bear.

Referring to FIG. 1, in an alternate embodiment 10', the canvas 36' is formed from fluid impermeable material for advantageously prohibiting snow 11 and debris from passing therethrough. This feature is advantageous for larger applications of the apparatus 10 that can effectively bear the weight of greater quantities of snow 11 and debris.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A snow removal apparatus for assisting a user to remove accumulated snow from a roof, said apparatus comprising:

an elongated rectilinear pole having a centrally disposed longitudinal axis and further having axially registered proximal and distal end portions;

a central anchor including a plurality of brackets equidistantly and radially spaced about a perimeter thereof, said anchor threadably and directly receiving said proximal end portion of said pole;

a plurality of coextensive paddles pivotally connected to said brackets respectively, each said paddle being articulated along a unique pivot axis between extended and retracted positions;

wherein said paddles are radially extended from and equidistantly juxtaposed along an outer perimeter of said anchor when a user exerts a linear force directed towards said proximal end portion of said pole for fanning said paddles to an extended position; and a flexible canvas directly connected to said paddles for collecting snow therein when said paddles are fanned to an open position.

2. The apparatus of claim 1, wherein said distal end portion of said pole includes a grip member directly conjoined thereto for increasing a user's grip.

3. The apparatus of claim 1, wherein said canvas is formed from mesh material for allowing a selected quantity of snow and debris to pass therethrough when the user pulls said apparatus away from an edge of a roof top.

4. The apparatus of claim 1, wherein said central anchor has a protrusion extending parallel to the longitudinal axis such that a user can easily insert the apparatus into a bank of snow when said paddles are at a retracted position.

5. The apparatus of claim 1, wherein said brackets are securely and statically fastened to said anchor such that said paddles move along a fixed and predetermined arcuate path during operating conditions.

6. The apparatus of claim 1, wherein said canvas is formed from fluid impermeable material for prohibiting snow and debris from passing therethrough.

7. A snow removal apparatus for assisting a user to remove accumulated snow from a roof, said apparatus comprising:

an elongated rectilinear pole having a centrally disposed longitudinal axis and further having axially registered proximal and distal end portions;

a central anchor including a plurality of brackets equidistantly and radially spaced about a perimeter thereof, said anchor threadably and directly receiving said proximal end portion of said pole;

a plurality of coextensive paddles pivotally connected to said brackets respectively, each said paddle being articulated along a unique pivot axis between extended and retracted positions;

wherein said paddles are radially extended from and equidistantly juxtaposed along an outer perimeter of said anchor when a user exerts a linear force directed towards said proximal end portion of said pole for fanning said paddles to an extended position; and a flexible canvas directly connected to said paddles for collecting snow therein when said paddles are fanned to an open position, said canvas being foldable to a compact position when said paddles are articulated to a closed position.

8. The apparatus of claim 7, wherein said distal end portion of said pole includes a grip member directly conjoined thereto for increasing a user's grip.

9. The apparatus of claim 7, wherein said canvas is formed from mesh material for allowing a selected quantity of snow and debris to pass therethrough when the user pulls said apparatus away from an edge of a roof top.

10. The apparatus of claim 7, wherein said central anchor has a protrusion extending parallel to the longitudinal axis such that a user can easily insert the apparatus into a bank of snow when said paddles are at a retracted position.

11. The apparatus of claim 7, wherein said brackets are securely and statically fastened to said anchor such that said paddles move along a fixed and predetermined arcuate path during operating conditions.

12. The apparatus of claim 7, wherein said canvas is formed from fluid impermeable material for prohibiting snow and debris from passing therethrough.

13. A snow removal apparatus for assisting a user to remove accumulated snow from a roof, said apparatus comprising:

an elongated rectilinear pole having a centrally disposed longitudinal axis and further having axially registered proximal and distal end portions;

a central anchor including a plurality of brackets equidistantly and radially spaced about a perimeter thereof, said anchor threadably and directly receiving said proximal end portion of said pole;

a plurality of coextensive paddles pivotally connected to said brackets respectively, each said paddle being articulated along a unique pivot axis between extended and retracted positions;

wherein said paddles are radially extended from and equidistantly juxtaposed along an outer perimeter of said anchor when a user exerts a linear force directed towards said proximal end portion of said pole for fanning said paddles to an extended position; and a flexible canvas directly connected to said paddles for collecting snow therein when said paddles are fanned to an open position, said canvas being foldable to a compact position when said paddles are articulated to a closed position, said canvas further having an outer edge provided with a radius substantially equal to a longitudinal length of said paddles.

14. The apparatus of claim 13, wherein said distal end portion of said pole includes a grip member directly conjoined thereto for increasing a user's grip.

15. The apparatus of claim 13, wherein said canvas is formed from mesh material for allowing a selected quantity of snow and debris to pass therethrough when the user pulls said apparatus away from an edge of a roof top.

16. The apparatus of claim 13, wherein said central anchor has a protrusion extending parallel to the longitudinal axis such that a user can easily insert the apparatus into a bank of snow when said paddles are at a retracted position.

17. The apparatus of claim 13, wherein said brackets are securely and statically fastened to said anchor such that said paddles move along a fixed and predetermined arcuate path during operating conditions.

18. The apparatus of claim 13, wherein said canvas is formed from fluid impermeable material for prohibiting snow and debris from passing therethrough.

* * * * *